US009185966B2

(12) United States Patent
Cooper

(10) Patent No.: US 9,185,966 B2
(45) Date of Patent: Nov. 17, 2015

(54) PERSONAL CARGO DEVICE

(71) Applicant: David Cooper, Clinton Township, MI (US)

(72) Inventor: David Cooper, Clinton Township, MI (US)

( * ) Notice: Subject to any disclaimer, the term of this patent is extended or adjusted under 35 U.S.C. 154(b) by 10 days.

(21) Appl. No.: 13/803,989

(22) Filed: Mar. 14, 2013

(65) Prior Publication Data

US 2013/0240581 A1 Sep. 19, 2013

Related U.S. Application Data

(60) Provisional application No. 61/611,629, filed on Mar. 16, 2012.

(51) Int. Cl.
*A45F 5/00* (2006.01)
*A45F 3/00* (2006.01)

(52) U.S. Cl.
CPC ..... *A45F 5/00* (2013.01); *A45F 2003/008* (2013.01)

(58) Field of Classification Search
CPC ..... A45F 2003/008; A45F 5/02; A45F 5/021; A45F 2003/144; A45F 2003/006; A45F 3/005; A45F 2005/008; Y10S 224/904
USPC ..... 224/661, 664, 665, 675, 581–583
See application file for complete search history.

(56) References Cited

U.S. PATENT DOCUMENTS

| | | | | |
|---|---|---|---|---|
| 4,804,121 | A * | 2/1989 | Stanton et al. | 224/191 |
| 5,314,102 | A * | 5/1994 | Roy | 224/586 |
| 5,465,889 | A * | 11/1995 | Smith | 224/677 |
| 5,746,542 | A * | 5/1998 | Carmichael | 405/186 |
| 6,065,659 | A * | 5/2000 | Faz | 224/661 |
| 6,446,852 | B1 * | 9/2002 | Sorensen et al. | 224/661 |
| 2004/0020959 | A1 * | 2/2004 | Sellars | 224/675 |

* cited by examiner

*Primary Examiner* — Adam Waggenspack
(74) *Attorney, Agent, or Firm* — P.A. Smith, LLC; Eric Jorgenson

(57) ABSTRACT

Embodiments may comprise a personal cargo device. According to some embodiments a personal cargo device may include an elongate strip defining a band, and the band may include fastening means at either end so that the ends may be joined. Furthermore, the bands may have at least one lateral fastening means disposed along the length of the band which is adapted to engage a hanging cargo member. A hanging cargo member may be so dimensioned as to substantially cover and/or protect a thigh of a wearer, and may include one or more integrated storage means. An integrated storage means may be closable with a closure flap, which may be removable from an embodiment.

18 Claims, 8 Drawing Sheets

PERSONAL CARGO DEVICE

I. REFERENCE TO RELATED APPLICATIONS

This application claims priority to U.S. Provisional Patent Application No. 61/611,629 filed Mar. 16, 2012, which is incorporated herein by reference in its entirety.

II. BACKGROUND OF THE INVENTION

A. Field of Invention

Some embodiments may generally relate to wearable devices for storing arbitrary objects and/or protecting selected parts of the body.

B. Description of the Related Art

It is known to have garments which are adapted to carry arbitrary objects. Such garments may include one or more pockets. For example, cargo pants or shorts may include relatively large pockets worn to the front or side of the thigh. However, such garments are not amenable to be worn over clothing other than traditional undergarments. What is needed is a device or garment which can be worn over clothing and provides means for adjustment and reconfiguration of the device or garment.

Some embodiments of the present invention may provide one or more benefits or advantages over the prior art.

III. SUMMARY OF THE INVENTION

Some embodiments may relate to a personal cargo device, comprising: an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band; and at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation, the hanging cargo member having at least one band fastening means disposed approximately at an edge of the hanging cargo member, wherein the band fastening means is adapted to cooperate with the at least one lateral fastening means of the band in joining the at least one hanging cargo member to the band in either a reversibly fastened relation or a permanently fastened relation.

According to some embodiments the band comprises a first length and a second length each having a first end and a second end, and wherein each length includes at least one medial fastening means disposed at one end which is adapted to cooperate in joining the first length and the second length in a length-adjustable relation.

According to some embodiments the band further comprises a sheath adapted to cover the medial fastening means, wherein the sheath includes a lateral opening means rendering the sheath openable along a length thereof.

According to some embodiments the sheath further comprises at least one integrated storage means adapted to receive arbitrary objects in a stowed relation.

According to some embodiments the band further comprises an elastic band section having a first end and a second end, wherein the elastic band section is joined at the first end to a first non-elastic band section, and is joined at the second end to a second non-elastic band section.

According to some embodiments the at least one hanging cargo member comprises a major sheet member having a generally elongate shape sized to substantially cover and protect the thigh of a wearer, and the main sheet member including approximately at one end the band fastening means for cooperating with the lateral fastening means of the band, the hanging cargo member further comprising a minor sheet member of a size smaller than that of the major sheet member, and the minor sheet member being fastened to the major sheet member along a portion of a periphery of the minor sheet member, together the major sheet member and minor sheet member defining an opening for receiving arbitrary objects into a storage space therebetween.

Some embodiments may further comprise a closure flap having a first end and an opposing second end, wherein the opposing ends of the closure flap each include at least one fastener, and wherein the at least one fastener of the first end is adapted to cooperate with a closure flap fastener of the major sheet member in a reversibly fastened relation, and the at least one fastener of the second end is adapted to cooperate with a closure flap fastener of the minor sheet member in a reversibly fastened relation.

According to some embodiments the major sheet further comprises a closure flap storage fastener spatially separated from the integrated storage means, wherein closure flap may be fastened to the closure flap storage fastener while not engaging the integrated storage means.

According to some embodiments the at least one hanging cargo member further comprises a leg cinch at an end opposing that of the band fastening means, wherein the leg cinch is adapted to attach the hanging cargo member to a leg of a wearer.

According to some embodiments the at least one hanging cargo member comprises a pair of hanging cargo members spaced apart to roughly correspond to the location of a wearer's thighs.

According to some embodiments the closure flap fastener is disposed at an end of the at least one hanging cargo member opposing that of the band fastening means, and wherein the closure flap fastener and band fastening means are adapted to cooperate in reversibly joining the opposing ends where the opening for receiving arbitrary objects is disposed in an outward facing configuration.

Embodiments may relate to a personal cargo device, comprising: an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band, wherein the band comprises a first length and a second length each having a first end and a second end, wherein each length includes at least one medial fastening means disposed at one end which is adapted to cooperate in joining the first length and the second length in a length-adjustable relation, wherein the band further comprises a sheath adapted to cover the medial fastening means, and wherein the sheath includes a lateral opening means rendering the sheath openable along a length thereof; and at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation, the hanging cargo member having at least one band fastening means disposed approximately at an edge of the hanging cargo member, wherein the band fastening means is adapted to cooperate with the at least one lateral fastening means of the band in joining the at least one hanging cargo member to the band in either a reversibly fastened relation or a permanently fastened relation.

Embodiments may relate to a personal cargo device, comprising: an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band, wherein the band comprises a first length and a second length each having a first end and a second end, and wherein each length includes at least one medial fastening means disposed at one end which is adapted to cooperate in joining the first length and the second length in a length-adjustable relation, wherein the band further comprises a sheath adapted to cover the medial fastening means, wherein the sheath includes a lateral opening means rendering the sheath openable along a length thereof, wherein the band further comprises an elastic band section having a first end and a second end, and wherein the elastic band section is joined at the first end to a first non-elastic band section, and is joined at the second end to a second non-elastic band section; and at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation, the hanging cargo member having at least one band fastening means disposed approximately at an edge of the hanging cargo member, wherein the band fastening means is adapted to cooperate with the at least one lateral fastening means of the band in joining the at least one hanging cargo member to the band in either a reversibly fastened relation or a permanently fastened relation, wherein the at least one hanging cargo member comprises a major sheet member having a generally elongate shape sized to substantially cover and protect the thigh of a wearer, and the main sheet member including approximately at one end the band fastening means for cooperating with the lateral fastening means of the band, the hanging cargo member further comprising a minor sheet member of a size smaller than that of the major sheet member, and the minor sheet member being fastened to the major sheet member along a portion of a periphery of the minor sheet member, together the major sheet member and minor sheet member defining an opening for receiving arbitrary objects into a storage space therebetween, the hanging cargo member further comprising a closure flap having a first end and an opposing second end, wherein the opposing ends of the closure flap each include at least one fastener, and wherein the at least one fastener of the first end is adapted to cooperate with a closure flap fastener of the major sheet member in a reversibly fastened relation, and the at least one fastener of the second end is adapted to cooperate with a closure flap fastener of the minor sheet member in a reversibly fastened relation, and wherein, the major sheet further comprises a closure flap storage fastener spatially separated from the integrated storage means, wherein closure flap may be fastened to the closure flap storage fastener while not engaging the integrated storage means.

Other benefits and advantages will become apparent to those skilled in the art to which it pertains upon reading and understanding of the following detailed specification.

IV. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

V. DETAILED DESCRIPTION OF THE INVENTION

Figure 1:
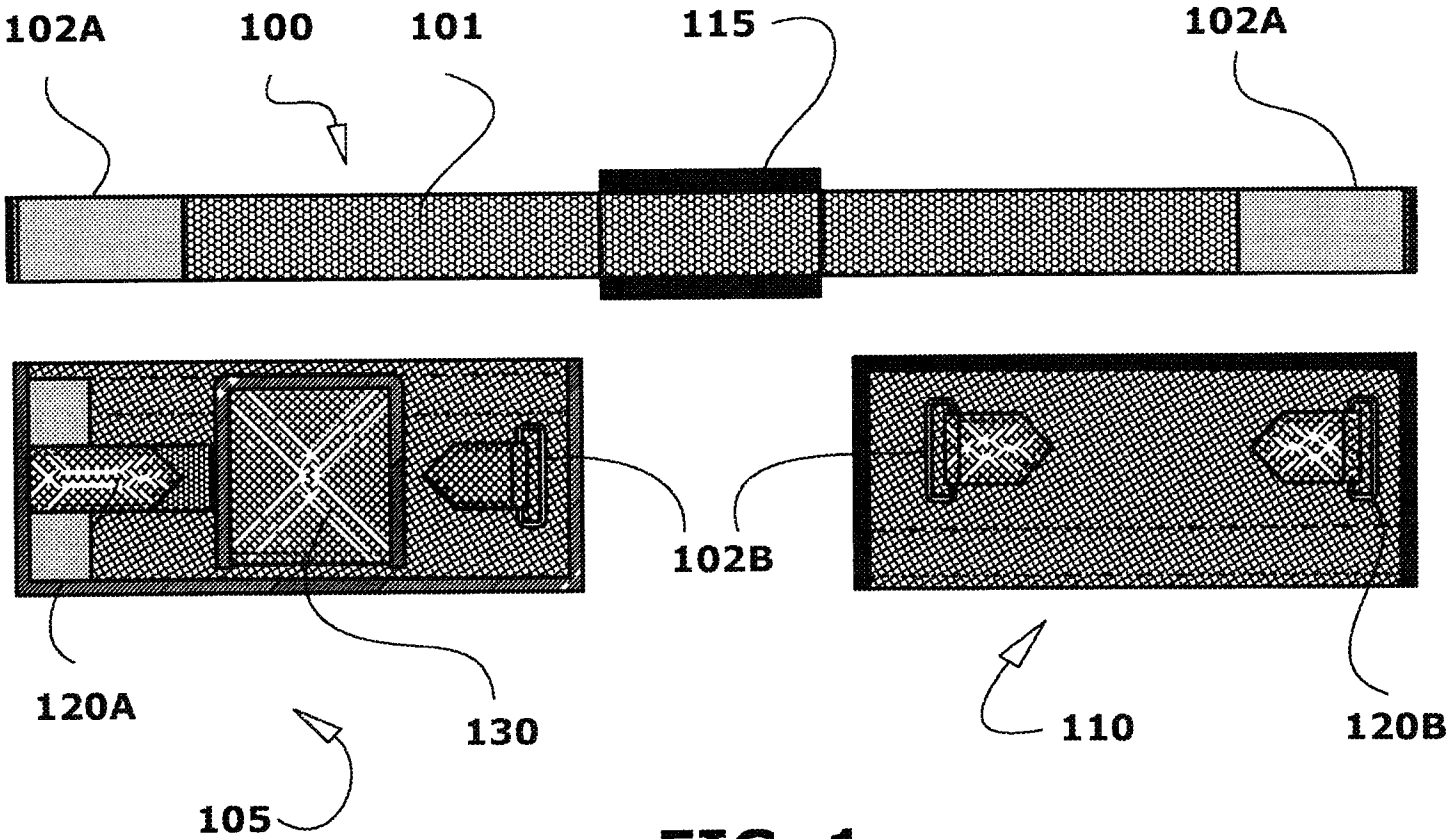
FIG. 1 shows a band according to an embodiment including a plurality of sections thereof.

Some embodiments may comprise a personal cargo device. A personal cargo device may include an elongate strip defining a band. Suitable bands can include, without limitation, belts, sashes or other devices for affixing the embodiment to a part of the human body. Typically, an embodiment may be worn around the waist; however, other configurations may also be suitable such as over the shoulder or in the form of a bandoleer. One skilled in the art will recognize that a number of different fastening means may be suitable for joining the ends of the band together. For instance, suitable fasteners can include, without limitation, any of a wide variety of buckles, snaps, buttons, hook-and-loop fasteners, or any combination thereof. Furthermore, a band may comprise a plurality of lengths or sections, which may be joined together in a length-adjustable relation or in a non-adjustable relation. Adjustable embodiments may include one or more D-ring members or similar means for slidably engaging a section of the band. Fasteners used in this way may be referred to herein as medial fastening means. Embodiments that include such length-adjustment means may also include a sheath for hiding the length-adjustment means from view.

A sheath according to embodiments described herein can comprise a generally tubular structure comprising fabric, leather or other convenient materials, and may have an opening at either end of the tubular structure to allow a band or one or more lengths thereof to pass through. Furthermore, sheaths may include lateral opening means which may allow a user to split the tubular structure along a length thereof which may allow the user to remove or replace the sheath without disassembling the embodiment. A suitable lateral opening means can comprise a variety of structures known in the art including, without limitation, zip fasteners, hook-and-loop fasteners, snaps, buttons, and the like or any combination thereof. A sheath member may also include an integrated storage means. For instance, the sheath may define a major sheet to which a smaller minor sheet is joined about a portion of its periphery leaving an opening and defining a space between the major and minor sheets which is suitable for receiving arbitrary objects in a stowed relation.

Additionally or alternatively, embodiments may include a band having at least one elastic section allowing the band to stretch in a lengthwise direction. For example, a pair of band sections may be joined by an interposed elastic band section, thus allowing a length of the band to increase or decrease as needed. One skilled in the art will appreciate that a variety of lengths of an elastic band section can be appropriate depending upon the degree of length adjustment desired. For instance, if a band is to have a relatively high degree of dynamic length adjustment, then a longer elastic band length may be used. Furthermore, one skilled in the art will appreciate that a wide variety of means for joining an elastic band section can be appropriate and can include either permanent joining means or reversible joining means. Reversible joining means can include, without limitation, any of a wide variety of buckles, snaps, buttons, hook-and-loop fasteners, or any combination thereof. Permanent joining means can include, without limitation, sewing, chemical bonding, heat bonding, or other permanent means.

Embodiments may include one or more hanging cargo members that include a band fastening means. According to such embodiments a band fastening means may cooperate with a lateral fastening means disposed on the band to join the hanging cargo member to the band in a reversibly joined or permanently joined relation. One skilled in the art will recognize that band fastening means and lateral fastening means may be selected from a wide variety of fasteners known in the art including, without limitation, any of a wide variety of buckles, snaps, buttons, hook-and-loop fasteners, or any combination thereof. However, in some embodiments the band and hanging cargo member may be permanently joined through sewing, chemical bonding, heat bonding, or other permanent means.

According to some embodiments a hanging cargo member can comprise a major sheet having a generally elongate shape and a minor sheet having a size smaller than that of the major sheet. The minor sheet may be permanently joined to the major sheet about a portion of a periphery of the minor sheet, leaving an opening and cooperatively defining an integrated storage means. The opening may be suitable for receiving arbitrary objects, for instance, for temporary storage in the space between the major sheet and minor sheet. Such embodiments may also include a closure flap for substantially closing the opening which communicates with the space between the major sheet and the minor sheet. A closure flap may be permanently or reversibly joined to the major sheet at one edge of the closure flap, while an opposing edge of the closure flap may be reversibly joined to the minor sheet when the closure flap is in a closed configuration, and may be detached from the minor sheet when the closure flap is in an open configuration.

According to some embodiments, a closure flap which is fully detachable from both the minor sheet and the major sheet may be reversibly attachable to an alternative portion of the major sheet in a stowed configuration. One skilled in the art will appreciate that a wide variety of fastening means may be suitable for reversibly joining a closure flap to a major sheet, minor sheet or alternative portion of the major sheet. For example, such mean can include any of a wide variety of buckles, snaps, buttons, hook-and-loop fasteners, or any combination thereof. Similarly, one of skill in the art will also appreciate that a wide variety of means for permanently joining an edge of a closure flap to a major sheet may also be suitable such as, without limitation, sewing, chemical bonding, heat bonding, or other permanent means.

Hanging cargo members of some embodiments may include one or more leg cinches for attaching the cargo member to the leg of a wearer. For instance, a hanging cargo member may hang over a thigh of a wearer. Thus, the hanging cargo member may swing as the wearer ambulates, which may be uncomfortable. Accordingly, a leg cinch may be provided, for instance at a lower end of the hanging cargo member, for attaching the member to the leg of a wearing so that it moves with the leg of the wearer rather than swinging independently.

Embodiments that include one or more hanging cargo members that are detachable from the band, and which also include a fastening means at a lower end of the hanging cargo member, may be converted into a hand-held bag. For instance, if the band fastening means is co-operable with a fastening means located at a lower end of the hanging cargo member, then the two ends may be joined in a configuration which places the minor sheet member in an outward position, and which may place the leg cinch in an upward orientation. Such a configuration may be essentially that of a shoulder bag.

Embodiments may be made from a wide variety of materials, as will be understood by one skilled in the art. Non-limiting examples of such materials include leather, woven fabrics made from natural fibers and/or synthetic fibers, nylon fabrics, polyester fabrics, cotton fabrics, and the like. Essentially any textile fabric may be appropriate depending upon the specific application for which the embodiment is produced. For instance, hikers, rock climbers, or hunters may require materials which are especially light and durable. Similarly, military infantry applications may require light and tough fabrics which are also flame retardant or resist puncture. One skilled in the art would be able to select a fabric which suits those particular needs.

Referring now to the drawings wherein the showings are for purposes of illustrating embodiments of the invention only and not for purposes of limiting the same, FIG. 1 is a view of a band 100 having a plurality of sections 105, 110. Thus, structures 105 and 110 each comprise components of the band 100. According to the embodiment shown in FIG. 1 sections 105 and 110 are joined by a medial section 101 which includes hook-and-loop fasteners at either end 102A of the medial section 101 that cooperate with buckles 102B to join sections 101, 105 and 110. The medial section 101 also includes a stretchable member 115 which allows the band 100 to dynamically adjust in length. The stretchable member 115 may be made from an elastic fabric such as Lycra® or other suitable materials as will be apparent to those skilled in the art. As shown in FIG. 1, section 105 also includes an integrated storage means 130.

Figure 2:
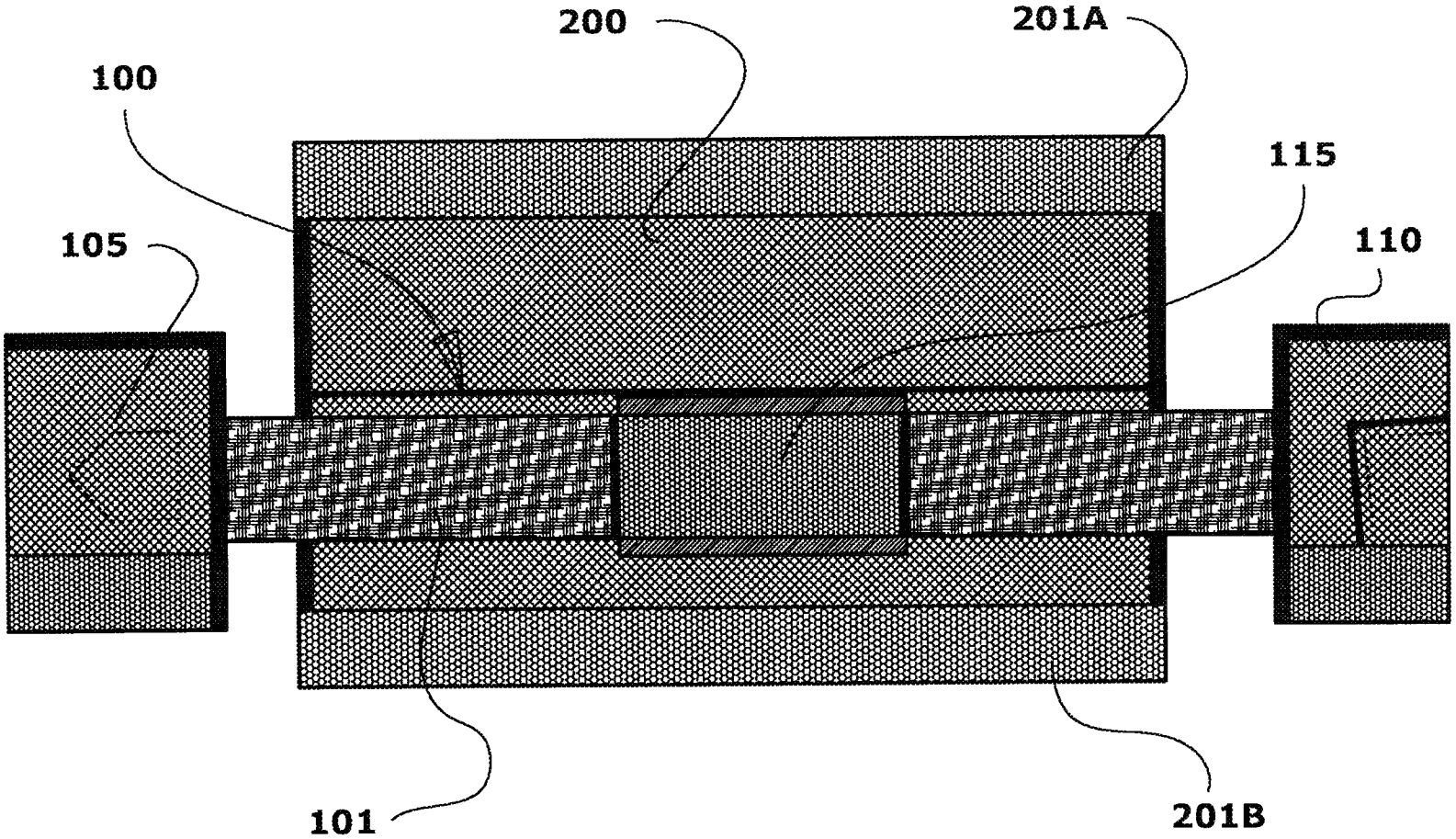
FIG. 2 shows how a band may be assembled and includes placement of a removable sheath.

FIG. 2 is a close-up view of the band 100 showing sections 105 and 110 joined by medial section 101. The medial section 101 of the band 100 is shown overlaying a sheath member 200, which is in an open configuration. The sheath member 200 is closeable with hook-and-loop fasteners 201A and 201B which are disposed on opposing edges of the sheath member 200. As shown, the sheath member 200 can be installed and removed without the need to disassemble sections 101, 105 and 110 and thus may serve as a significant convenience in addition to providing a pleasing aesthetic.

Figure 3:
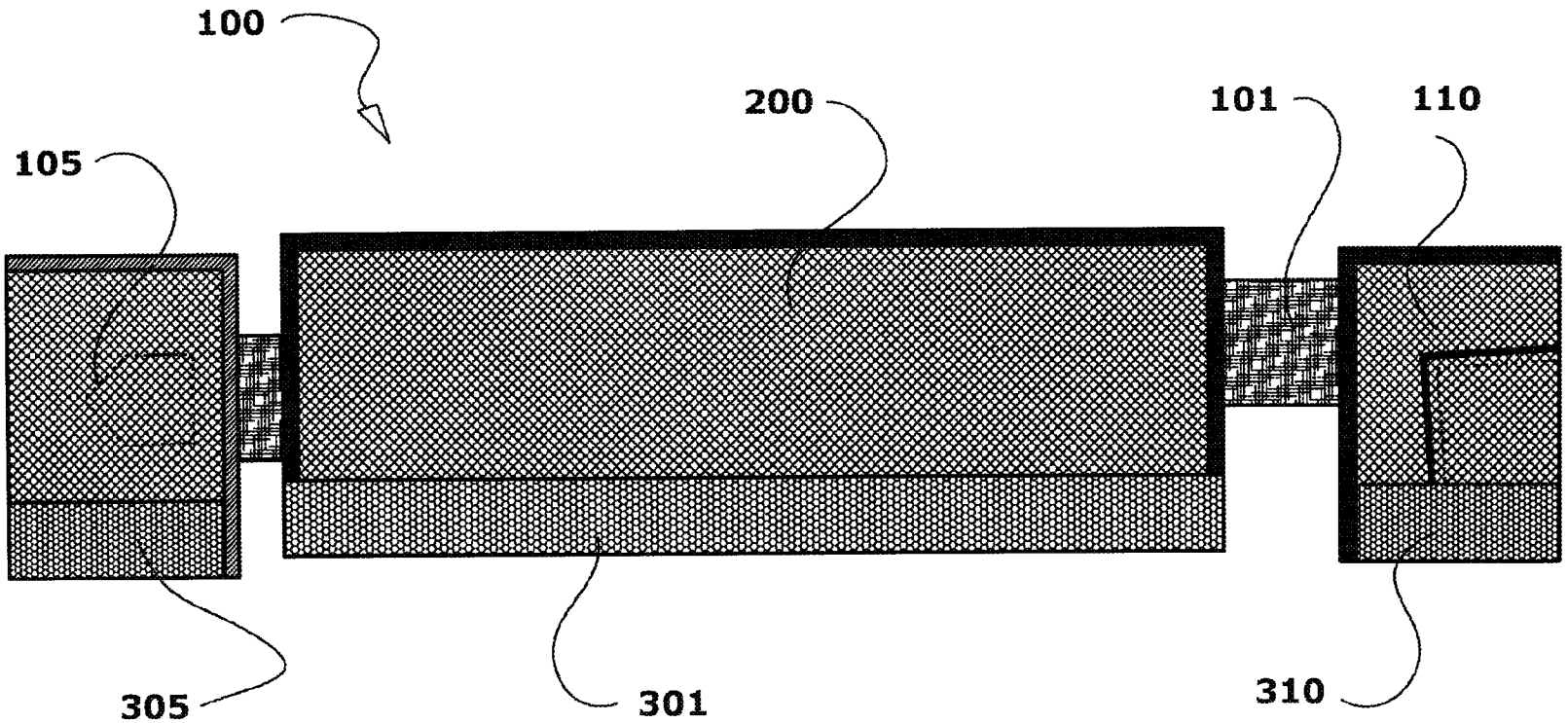
FIG. 3 shows an installed removable sheath.
Figure 4:
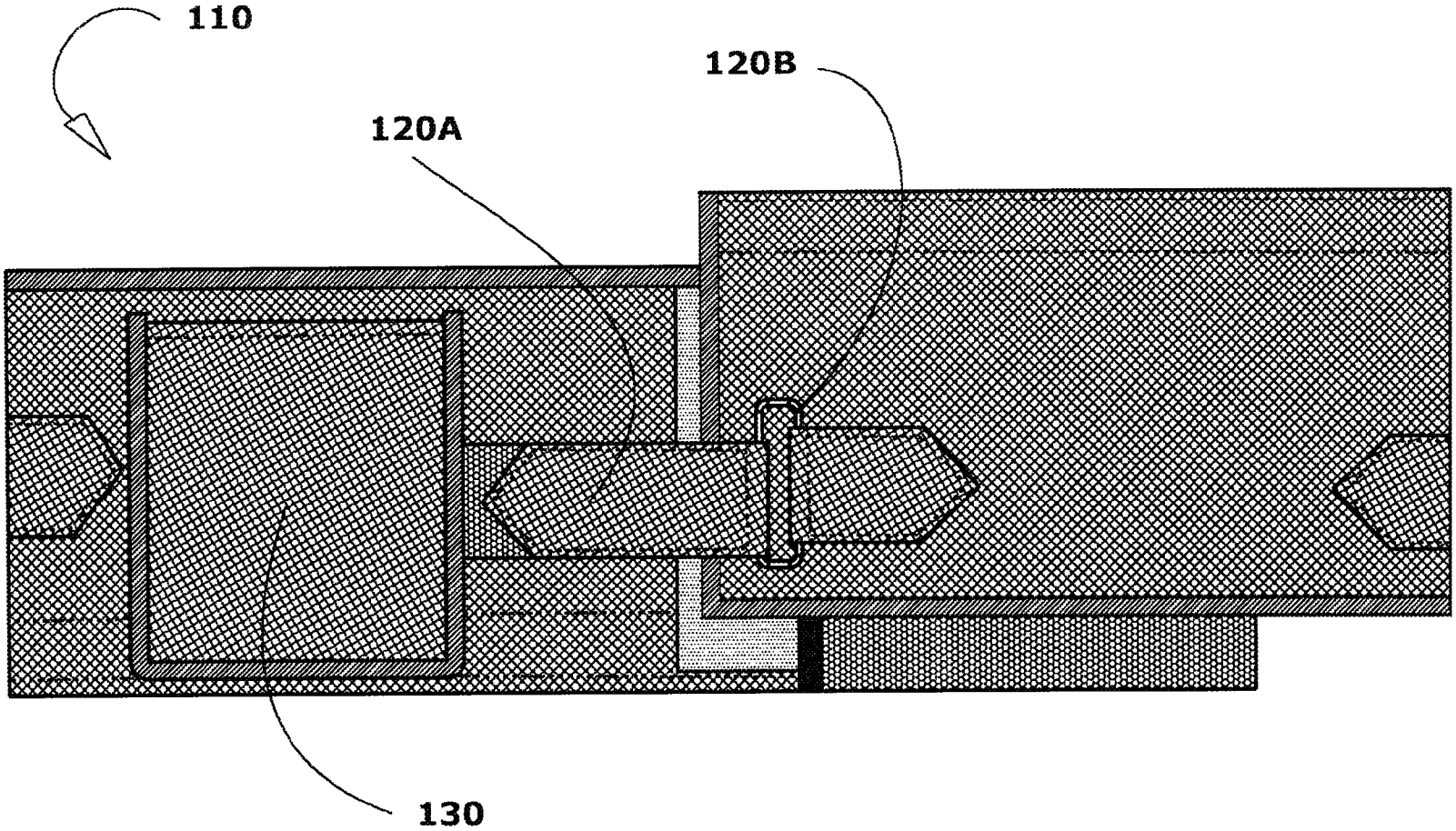
FIG. 4 shows a band fully assembled according to one embodiment.

FIG. 3 is similar to FIG. 2 except that the sheath 200 is in a closed configuration. The surface in view is that which contacts the body of a wearer. A loop portion of a hook-and-loop fastener is visible 305, 301, and 310 at the lower edge of each section 105, 101, and 110 of the band 100. Thus, attachments may be made to the band 100 which tend to resist inadvertent removal because the attachments are between the band 100 and the body of the wearer. FIG. 4 is a view of the band 100 fully assembled and with the band closures 120A and 120B engaged. Also visible is the integrated storage means 130.

Figure 5:
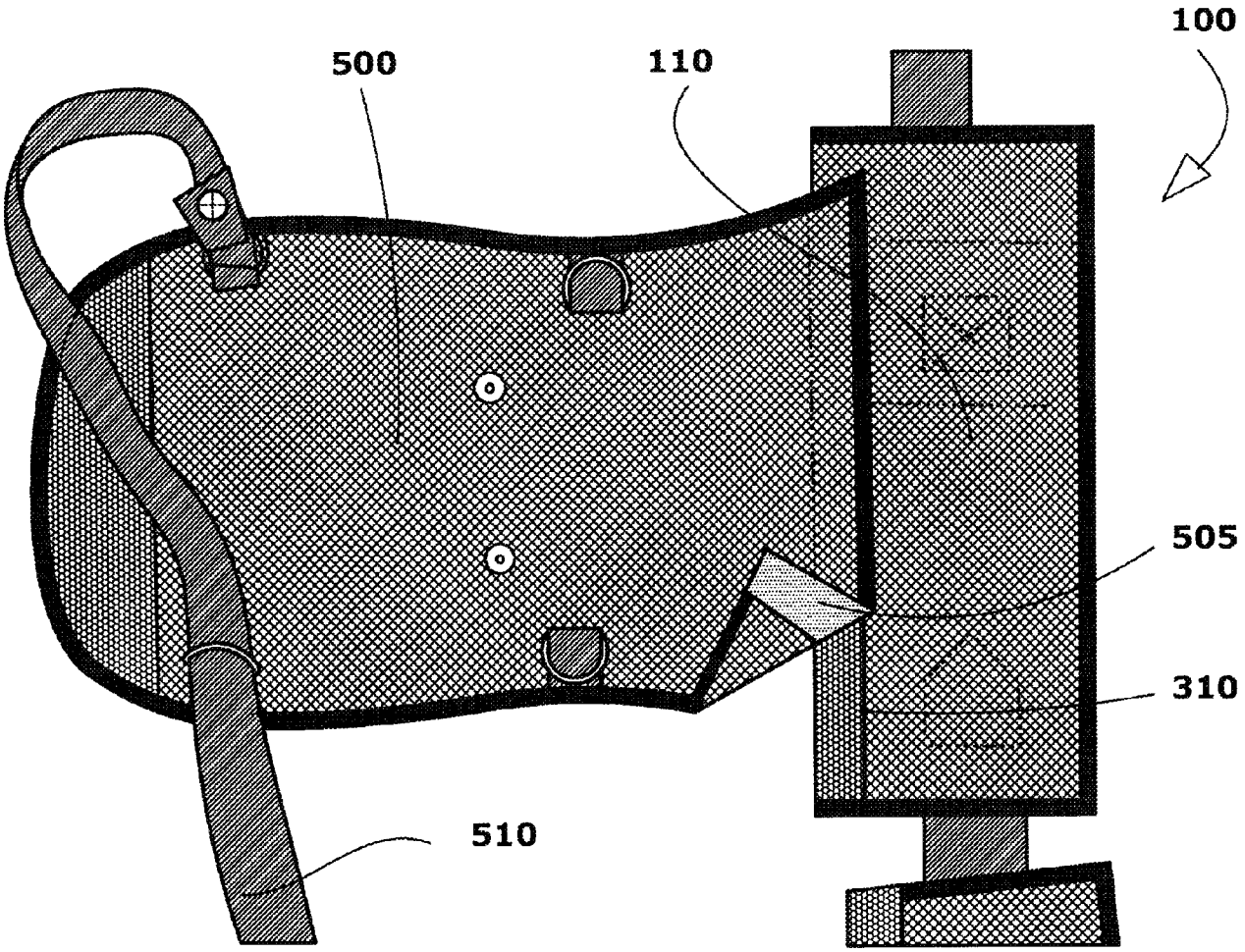
FIG. 5 shows a detachable hanging cargo member engaging a band.
Figure 6:
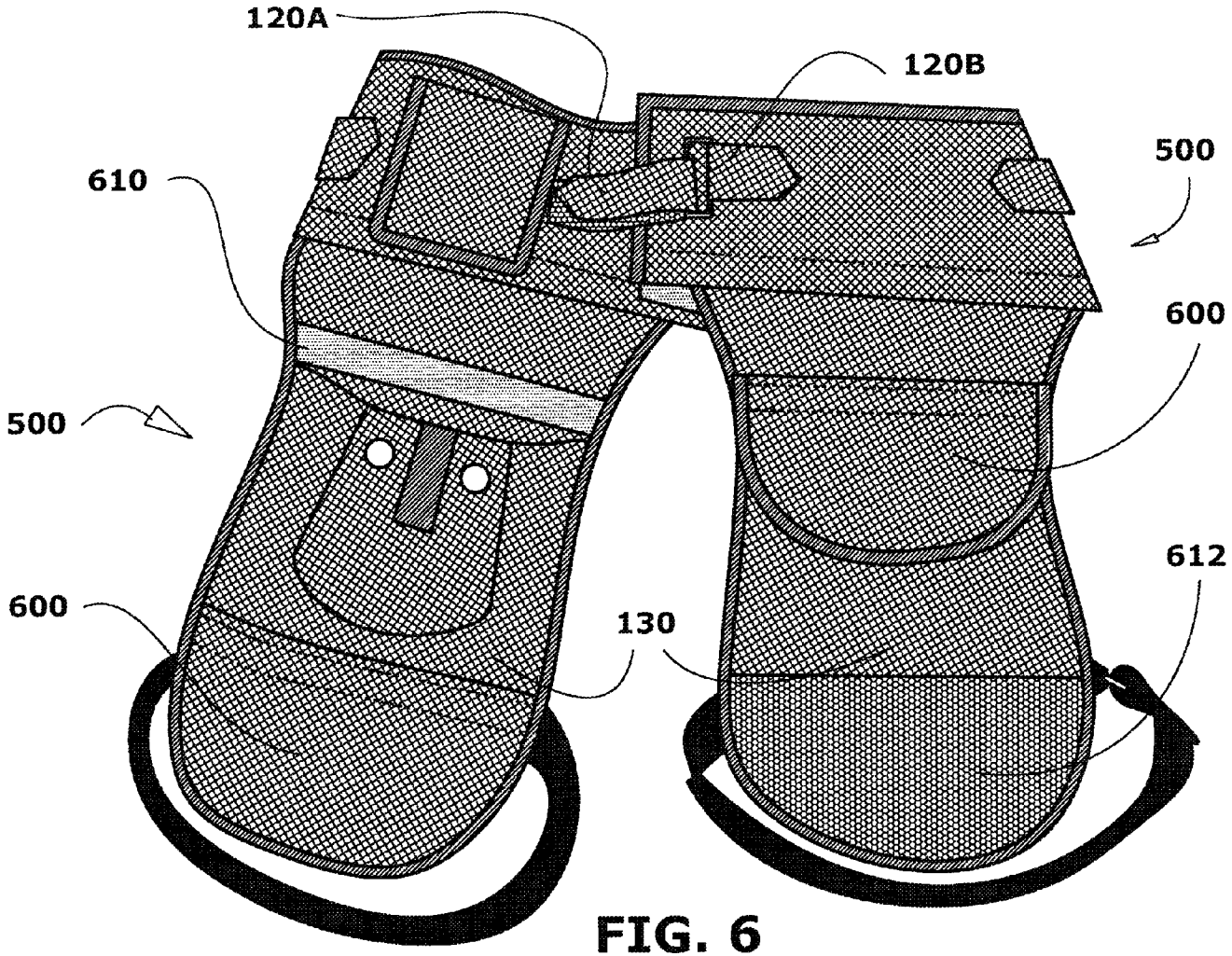
FIG. 6 shows a pair of hanging cargo members installed on a band, and also shows removable closure flaps including alternative placements thereof.

FIG. 5 shows a section 110 of the band 100 with a hanging cargo member 500 fastened thereto with a hook-and-loop fastener 505, 310. The hanging cargo member 500 is sized to substantially cover the thigh of a wearer, and includes a leg cinch 510 to affix the member 500 to the thigh. FIG. 6 illustrates a fully assembled embodiment with the band closures 120A, 120B engaged. Also, shown in FIG. 6 is a pair of hanging cargo members 500 spaced apart to substantially cover and/or protect each thigh of a wearer, and each including a removable closure flap 600. The removable flap 600 may be fastened to the embodiment as a closure for the integrated storage means 130 using a hook-and-loop fastener 610. Alternatively, the closure flap 600 may be attached to a flap storage means 612, which may comprise a hook-and-loop fastener or other suitable means of reversible attachment. Such a flap storage means 612 may be described herein as an alternative portion of the major sheet to which a closure flap 600 may be attached in a stowed configuration.

Figure 7:
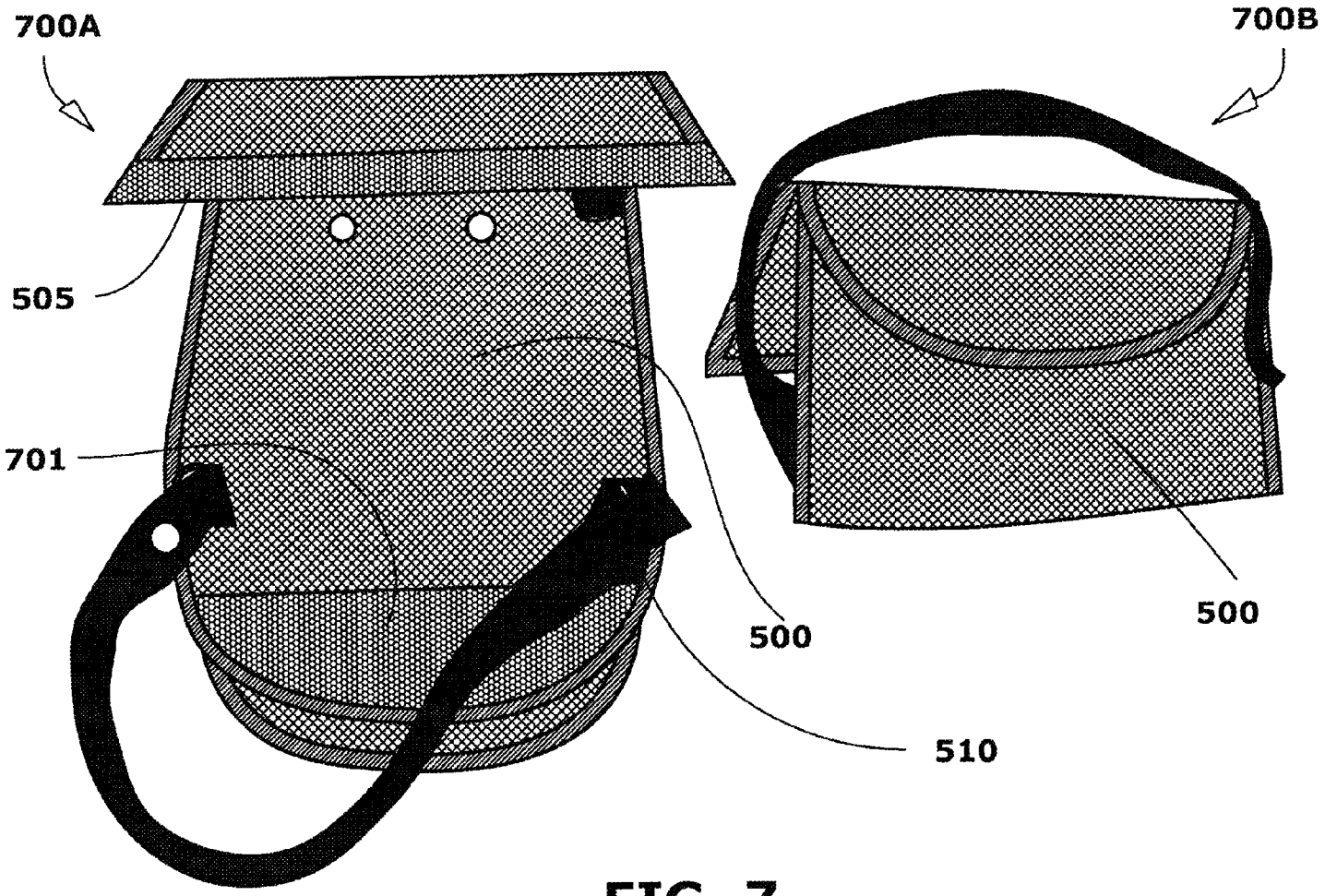
FIG. 7 shows how a hanging cargo member may be reconfigured into a new device.

FIG. 7 illustrates an alternative configuration 700B of a hanging cargo member 500. As shown in FIG. 7, a top edge of a hanging cargo member 500 having a hook-and-loop fastener 505 may be folded 700A. Folding as shown in 700A may engage the top edge hook-and-loop fastener 505 with a bottom edge hook-and-loop fastener 701 disposed on an opposing face of the hanging cargo member 500. The resulting configuration 700B is essentially that of a handbag, where the leg cinch 510 serves as a shoulder strap.

Figure 8:
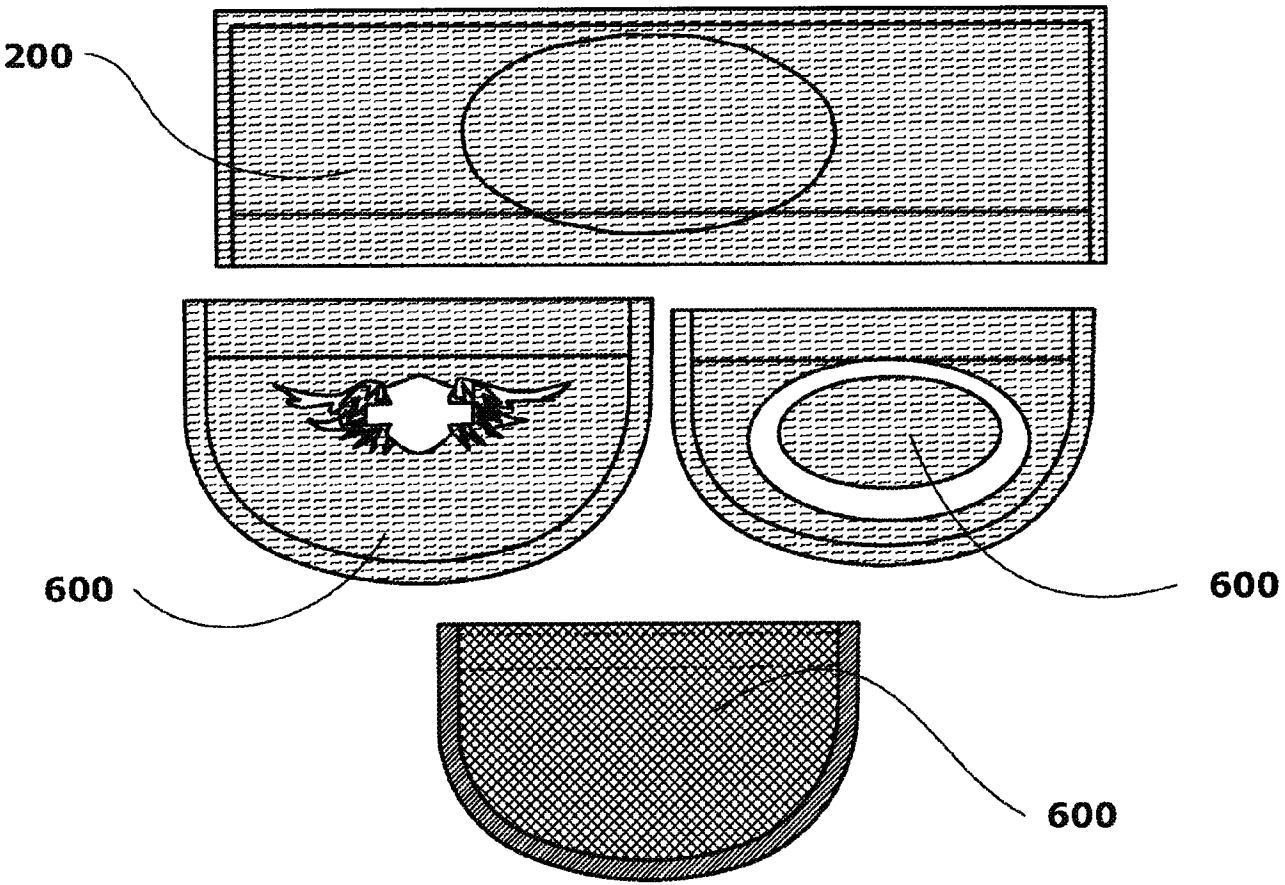
FIG. 8 shows a plurality of material choices and designs which may comprise and/or be used in association with an embodiment.

FIG. 8 illustrates a plurality of material choices and ornamental designs which may be applied to an embodiment. Particularly, the sheath member 200 is shown made from leather and bearing a company logo. Additionally, three different closure flaps 600 are shown made from leather and from an acrylic fabric having a camouflage design. A wearer may thus select components which produce a desired look, or display a selected logo or design.

The embodiments have been described, hereinabove. It will be apparent to those skilled in the art that the above methods and apparatuses may incorporate changes and modifications without departing from the general scope of this invention. It is intended to include all such modifications and alterations insofar as they come within the scope of the appended claims or the equivalents thereof.

Having thus described the invention, it is now claimed:

1. A personal cargo device, comprising:

an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band;

at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation, the hanging cargo member having at least one band fastening means disposed approximately at an edge of the hanging cargo member, wherein the band fastening means is adapted to cooperate with the at least one lateral fastening means of the band in joining the at least one hanging cargo member to the band in a reversibly fastened relation; and a leg cinch at an end of the at least one hanging cargo member opposing that of the band fastening means, wherein the leg cinch is adapted to attach the hanging cargo member to a leg of a wearer, wherein, upon detachment, the at least one hanging cargo portion is foldable so that the band fastening means engages with a fastener disposed on an opposing face of the hanging cargo member, such that a resulting configuration is a handbag, where the leg cinch serves as a shoulder strap.

2. The personal cargo device of claim 1, wherein the band comprises a first length and a second length each having a first end and a second end, and wherein each length includes at least one medial fastening means disposed at one end which is adapted to cooperate in joining the first length and the second length in a length-adjustable relation.

3. The personal cargo device of claim 2, wherein the band further comprises a sheath adapted to cover the medial fastening means, wherein the sheath includes a lateral opening means rendering the sheath openable along a length thereof.

4. The personal cargo device of claim 3, wherein the sheath further comprises at least one integrated storage means adapted to receive arbitrary objects in a stowed relation.

5. The personal cargo device of claim 1, wherein the at least one hanging cargo member comprises a major sheet member having a generally elongate shape sized to substantially cover and protect the thigh of a wearer, and the main sheet member including approximately at one end the band fastening means for cooperating with the lateral fastening means of the band, the hanging cargo member further comprising a minor sheet member of a size smaller than that of the major sheet member, and the minor sheet member being fastened to the major sheet member along a portion of a periphery of the minor sheet member, together the major sheet member and minor sheet member defining an opening for receiving arbitrary objects into a storage space therebetween.

6. The personal cargo device of claim 5, further comprising a closure flap having a first end and an opposing second end, wherein the opposing ends of the closure flap each include at least one fastener, and wherein the at least one fastener of the first end is adapted to cooperate with a closure flap fastener of the major sheet member in a reversibly fastened relation, and the at least one fastener of the second end is adapted to cooperate with a closure flap fastener of the minor sheet member in a reversibly fastened relation.

7. The personal cargo device of claim 6, wherein the major sheet further comprises a closure flap storage fastener spatially separated from the integrated storage means, wherein the closure flap may be fastened to the closure flap storage fastener while not engaging the integrated storage means.

8. The personal cargo device of claim 1, wherein the band further comprises an elastic band section having a first end and a second end, wherein the elastic band section is joined at the first end to a first non-elastic band section, and is joined at the second end to a second non-elastic band section.

9. The personal cargo device of claim 1, wherein the at least one hanging cargo member comprises a pair of hanging cargo members spaced apart to roughly correspond to the location of a wearer's thighs.

10. The personal cargo device of claim 1, wherein the at least one lateral fastening means and the band fastening means each comprises cooperating hook-and-loop fastener portions, attached respectively to the band and the hanging cargo member, for detachably fastening the band to the edge of the hanging cargo member.

11. A personal cargo device, comprising:

an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band, wherein the band comprises a first length and a second length each having a first end and a second end, wherein each length includes at least one medial fastening means disposed at one end which is adapted to cooperate in joining the first length and the second length in a length-adjustable relation, wherein the band further comprises a sheath adapted to cover the medial fastening means, and wherein the sheath includes a lateral opening means rendering the sheath openable along a length thereof;

at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation, the hanging cargo member having at least one band fastening means disposed approximately at an edge of the hanging cargo member, wherein the band fastening means is adapted to cooperate with the at least one lateral fastening means of the band in joining the at least one hanging cargo member to the band in a reversibly fastened relation, the band fastening means comprises a band hook-and-loop fastener of the band and a top edge hook-and-loop fastener of the edge of the hanging cargo member, wherein the at least one hanging cargo member is detachably fastened to the band with the band and top edge hook-and-loop fasteners; and a leg cinch at an end of the at least one hanging cargo member opposing that of the band fastening means, wherein the leg cinch is adapted to attach the hanging cargo member to a leg of a wearer, wherein, upon detachment, the at least one hanging cargo portion is foldable so that the top edge hook-and-loop fastener engages with a bottom edge hook-and-loop fastener disposed on an opposing face of the hanging cargo member, such that a resulting configuration is a handbag, where the leg cinch serves as a shoulder strap.

12. The personal cargo device of claim 11, wherein the at least one hanging cargo member comprises a major sheet member having a generally elongate shape sized to substantially cover and protect the thigh of a wearer, and the main sheet member including approximately at one end the band fastening means for cooperating with the lateral fastening means of the band, the hanging cargo member further comprising a minor sheet member of a size smaller than that of the major sheet member, and the minor sheet member being fastened to the major sheet member along a portion of a periphery of the minor sheet member, together the major sheet member and minor sheet member defining an opening for receiving arbitrary objects into a storage space therebetween.

13. The personal cargo device of claim 12, further comprising a closure flap having a first end and an opposing second end, wherein the opposing ends of the closure flap each include at least one fastener, and wherein the at least one fastener of the first end is adapted to cooperate with a closure flap fastener of the major sheet member in a reversibly fastened relation, and the at least one fastener of the second end is adapted to cooperate with a closure flap fastener of the minor sheet member in a reversibly fastened relation.

14. The personal cargo device of claim 13, wherein the major sheet further comprises a closure flap storage fastener spatially separated from the integrated storage means, wherein the closure flap may be fastened to the closure flap storage fastener while not engaging the integrated storage means.

15. The personal cargo device of claim 11, wherein the sheath further comprises at least one integrated storage means adapted to receive arbitrary objects in a stowed relation.

16. The personal cargo device of claim 11, wherein the band further comprises an elastic band section having a first end and a second end, wherein the elastic band section is joined at the first end to a first non-elastic band section, and is joined at the second end to a second non-elastic band section.

17. The personal cargo device of claim 11, wherein the at least one hanging cargo member further comprises a removable closure flap that fastens to the hanging cargo member using cooperating hook-and-loop fastener portions, to provide a closure for the at least one integrated storage means.

18. A personal cargo device, comprising:

an elongate strip defining a band having a first end and a second end, the band having a first fastening means disposed at the first end and a second fastening means disposed at the second end, wherein the first and second fastening means are adapted to cooperate in joining the first and second ends in a fastened relation, the band having at least one lateral fastening means disposed along the length of the band;

at least one hanging cargo member, so dimensioned as to substantially cover and protect the thigh of a wearer, having at least one integrated storage means adapted to store arbitrary objects, the integrated storage means having at least one opening adapted to receive said arbitrary objects in a stowed relation;

band fastening means disposed approximately at a top edge of the hanging cargo member, wherein the band fastening means is adapted to cooperate with the at least one lateral fastening means of the band in joining the at least one hanging cargo member to the band in a reversibly fastened relation, the band fastening means comprises a band hook-and-loop fastener of the band and a top edge hook-and-loop fastener of the top edge of the hanging cargo member, wherein the at least one hanging cargo member is detachably fastened to the band with the band and top edge hook-and-loop fasteners; and a leg cinch at an end of the at least one hanging cargo member opposing that of the band fastening means, wherein the leg cinch is adapted to attach the hanging cargo member to a leg of a wearer, wherein upon detachment, the at least one hanging cargo portion is foldable so that the top edge hook-and-loop fastener engages with a bottom edge hook-and-loop fastener disposed on an opposing face of the hanging cargo member, such that a resulting configuration is a handbag.

* * * * *